US006416356B1

(12) United States Patent
Hutchins et al.

(10) Patent No.: US 6,416,356 B1
(45) Date of Patent: Jul. 9, 2002

(54) AC INTERFACE FOR ELECTRICAL EQUIPMENT RACKS

(75) Inventors: Michael Hutchins, Beaconsfield; Denis Bellemare, Montreal, both of (CA)

(73) Assignee: Astec International Limited (HK)

( * ) Notice: Subject to any disclaimer, the term of this patent is extended or adjusted under 35 U.S.C. 154(b) by 0 days.

(21) Appl. No.: 09/585,904

(22) Filed: Jun. 2, 2000

(51) Int. Cl.[7] ..... H01R 13/66
(52) U.S. Cl. ..... 439/532
(58) Field of Search ..... 439/532, 716, 439/712; 361/727, 724, 725

(56) References Cited

U.S. PATENT DOCUMENTS

| | | | | | |
|---|---|---|---|---|---|
| 3,430,190 | A | | 2/1969 | Verneau | 339/198 |
| 3,547,274 | A | | 12/1970 | Sosinksi | 211/89 |
| 3,576,520 | A | * | 4/1971 | Stauffer | 439/716 |
| 3,970,276 | A | | 7/1976 | Debaigt | 248/223 |
| 4,034,172 | A | | 7/1977 | Glover et al. | 200/51.1 |
| 4,073,563 | A | * | 2/1978 | Bailey et al. | 439/532 |
| 4,510,553 | A | | 4/1985 | Faultersack | 361/413 |
| 4,516,189 | A | | 5/1985 | Seaks, Jr. | 361/426 |
| 4,773,867 | A | | 9/1988 | Keller et al. | 439/49 |
| 4,808,114 | A | | 2/1989 | Mohri et al. | 439/76 |
| 4,878,860 | A | | 11/1989 | Matsouka | 439/716 |
| 5,037,310 | A | | 8/1991 | Marinello | 439/61 |
| 5,192,227 | A | | 3/1993 | Bales | 439/532 |
| 5,268,592 | A | | 12/1993 | Bellamy et al. | 307/43 |
| 5,320,564 | A | * | 6/1994 | Anderson | 439/716 |
| 6,160,699 | A | * | 12/2000 | Gibson et al. | 361/643 |

* cited by examiner

*Primary Examiner*—Brian Sircus
*Assistant Examiner*—Brian S. Webb
(74) *Attorney, Agent, or Firm*—Coudert Brothers LLP

(57) ABSTRACT

In a power converter rack in which power converters of varying heights are stacked, a selectably vertically positionable AC connector module is provided. The AC connector module releasably hooks into apertures in a vertical mounting strip attached to the rack adjacent to an AC cable duct. The AC connector module has a terminal block to which an AC cable can be attached, and a contact block with female power contacts and a protruding grounding pin that makes first contact with an equipment chassis. The grounding pin also has a beveled tip to align the chassis with the AC connector module as it is slid into place in the rack.

7 Claims, 6 Drawing Sheets

AC INTERFACE FOR ELECTRICAL EQUIPMENT RACKS

FIELD OF THE INVENTION

This invention relates to equipment racks for stacked power converters, and more particularly to an AC interface for connecting power converters or other electrical equipment having a high current demand to AC cabling at any desired height in the rack.

BACKGROUND OF THE INVENTION

Installations using large amounts of DC current, e.g. mainframe computers and the like, typically use a large number of AC-to-DC power converters or rectifiers mounted one above the other in rack cabinets. These converters typically have a chassis with a rear face on which connectors are provided for connecting the converters to rack-mounted AC input cables and DC output buses. Drawbacks of prior AC interfaces for high power rack mounted equipment include the excessive amount of space used for coupling the AC supply cables to the equipment and the fact that it is typically difficult to reconfigure AC plugs in the rack once the rack has been installed in a system.

It is also desirable to be able to slide individual power converters or the like into and out of the rack while the power circuits are live. Ideally, sliding the converter into the rack should automatically make secure contact with both the AC input and the DC output. One problem with such an arrangement is that the converters can be of different heights and can be placed in the rack at any desired height. Consequently, it would be advantageous to provide an AC connector module which can be mounted with a minimum number of tools at any incremental height in the rack so that it can be vertically and horizontally aligned with a mating connector on the converter chassis. The AC connector module also has to be able to accommodate various types of AC supply cables as well as loose conductors from conduit. It must also be able to handle high current demand while remaining compact and easy to install.

SUMMARY OF THE INVENTION

The present invention satisfies the above-stated requirements by providing a vertically extending AC cable duct along one side of the rack cabinet, and providing adjacent thereto a mounting strip which has a series of openings and notches at close intervals among its length. The mounting strip is arranged to receive AC connector modules that clip onto the strip at any desired incremental height and can be connected in that position to an appropriate AC power cable extracted from the cable duct.

To avoid the need for hand wiring inside the AC connector module, the connector module includes printed circuit interconnections between the posts to which the AC cable is connected and the contacts into which the power converter chassis is plugged. An individual power connector is guided into alignment with the AC connector module's contacts during the plug-in action by a protruding ground locator pin. This pin also makes sure that the ground contact is the first made and the last broken.

DESCRIPTION OF THE PREFERRED EMBODIMENT

Figure 1:
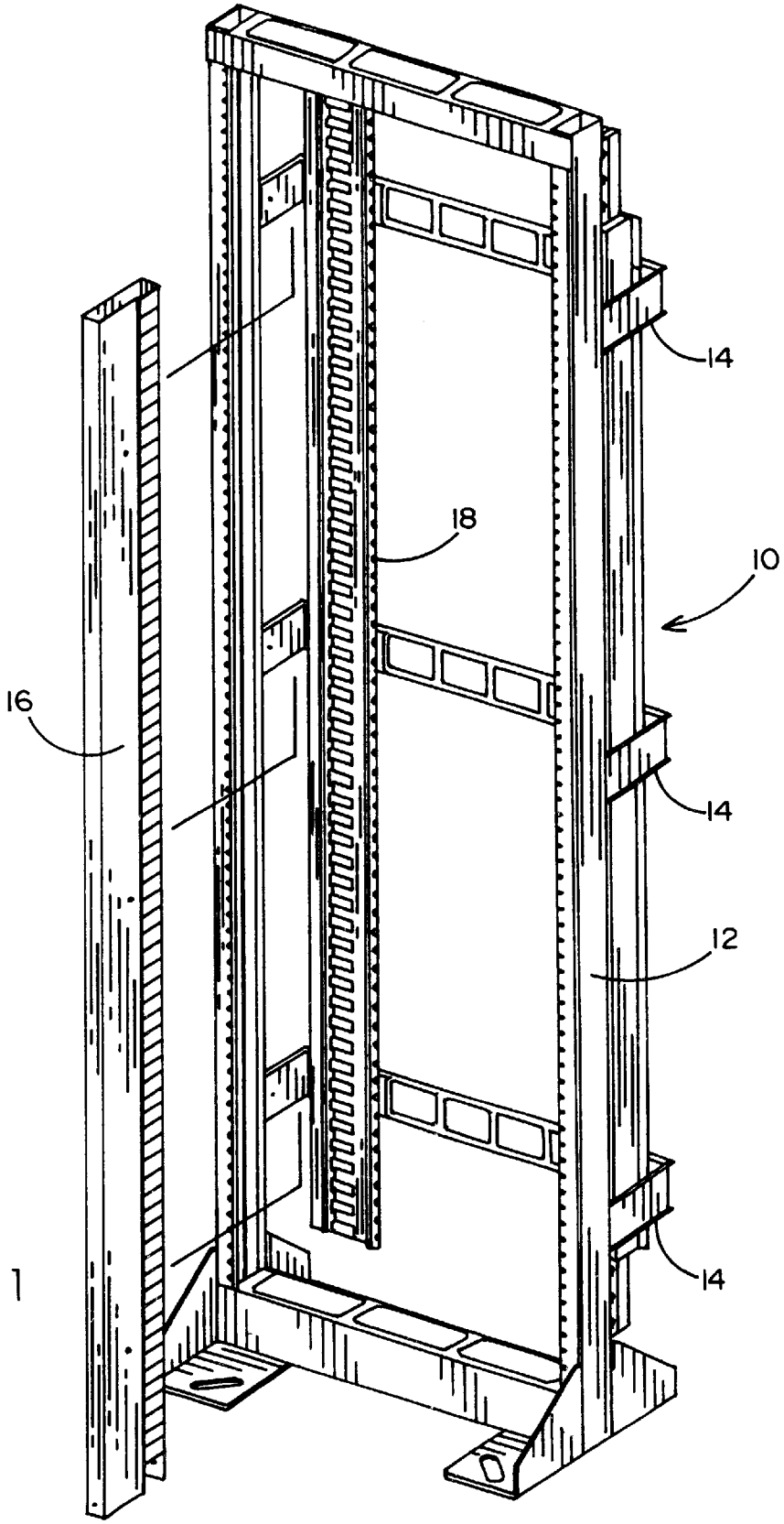
FIG. 1 is a perspective view of an equipment rack using the invention.

FIG. 1 is an overall view of an equipment rack 10. The frame 12 and braces 14 support a vertically extending cable duct 16 and a connector mounting strip 18. Individual cables can be brought out of the duct 16 through knock-out openings in the knock-out strip 20 which forms part of the duct wall.

Figure 2:
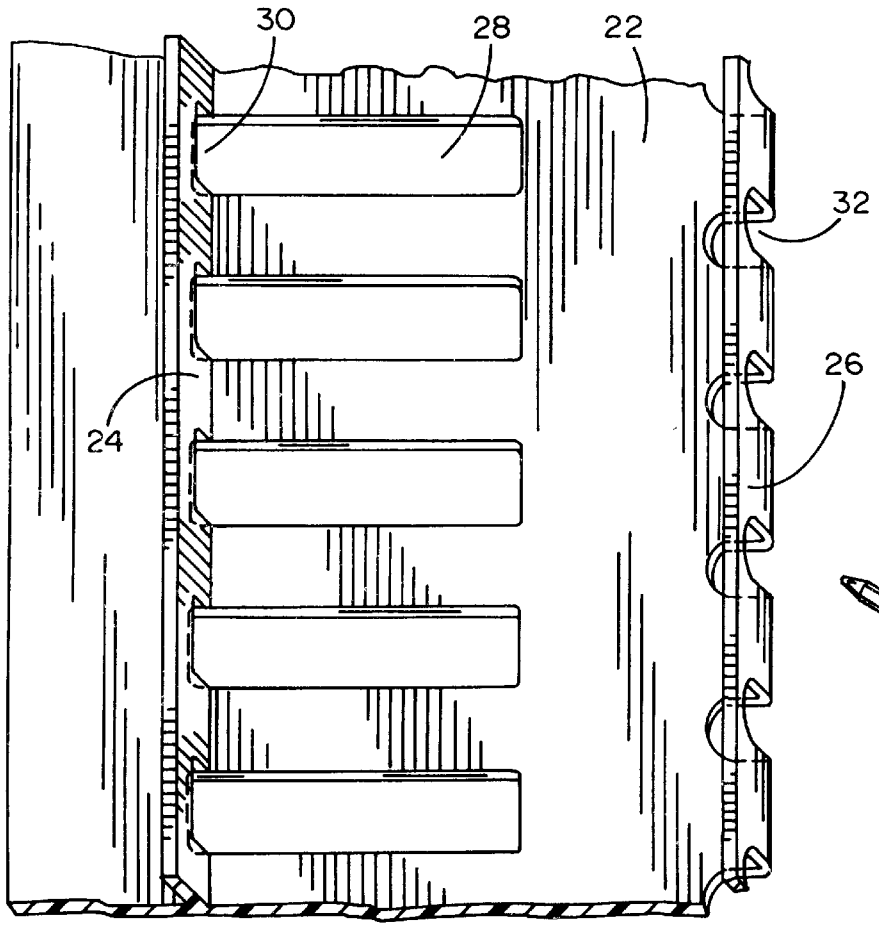
FIG. 2 is a detail perspective view showing the mounting strip.

The mounting strip 18 is shown in more detail in FIG. 2. It preferably takes the form of a vertically extending plate 22 mounted in the rear of the rack. The plate 22 has a pair of forward-facing flanges 24, 26. The plate 22 has formed therein a series of apertures 28 which abut the flange 24 and extend part way into it at 30. Corresponding apertures 32 are formed in the flange 26 at substantially the same vertical positions.

Figure 3:
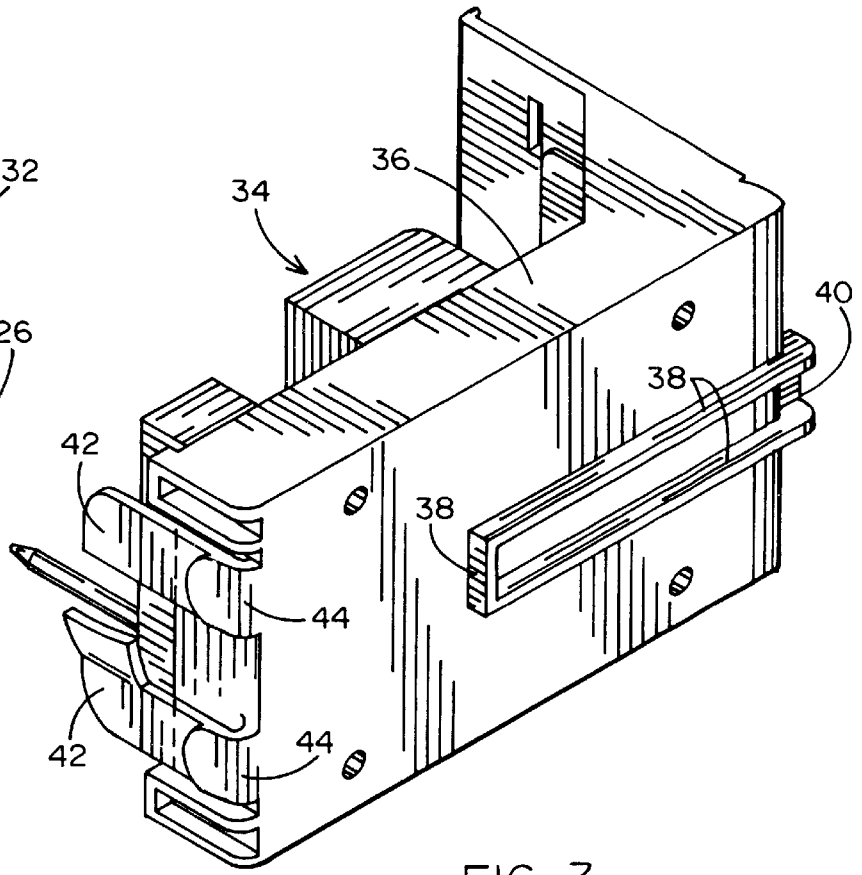
FIG. 3 is a rear view of the AC connector module.
Figure 4A:
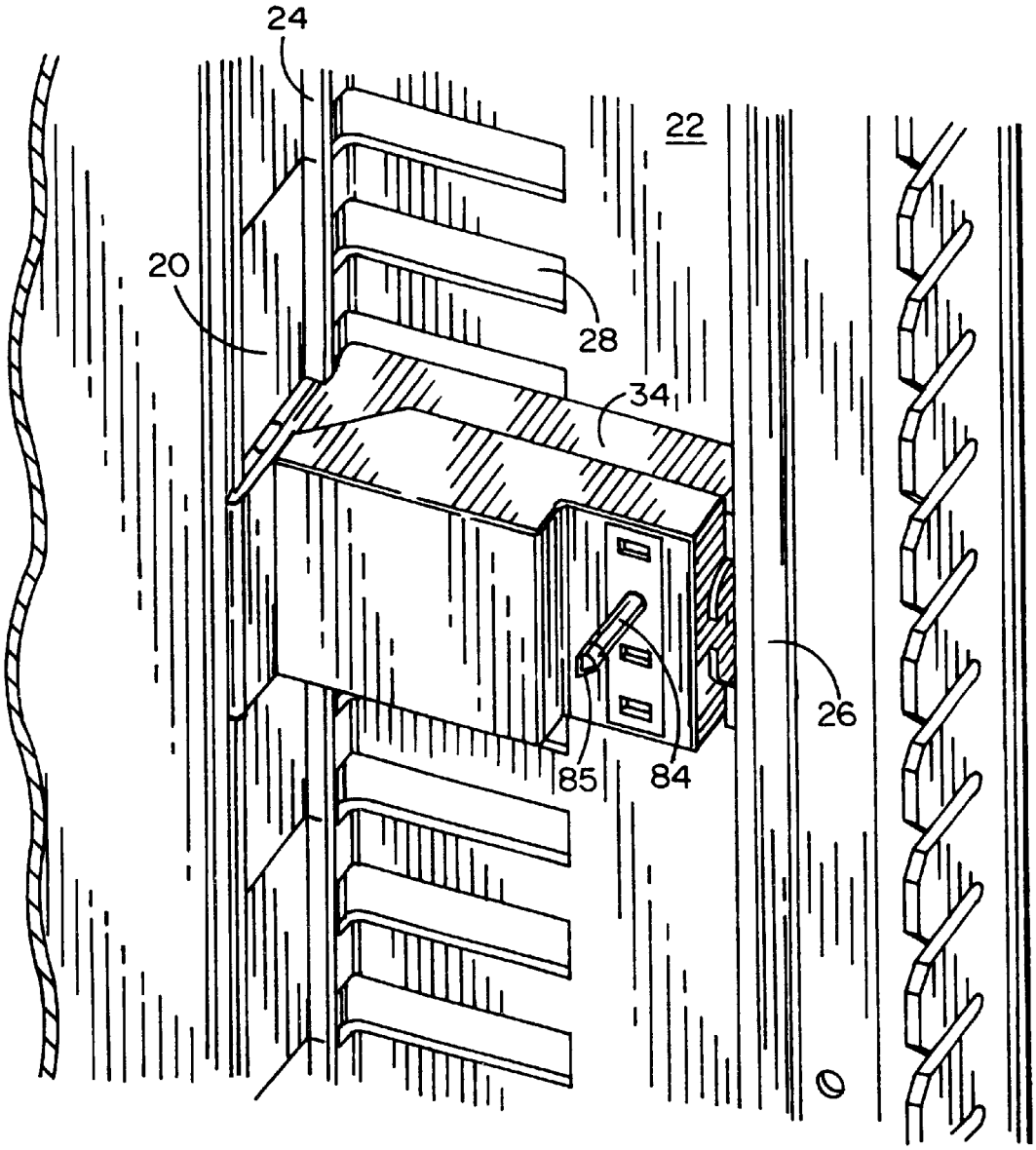
FIGS. 4*a* and 4*b* are detail perspective views showing the AC connector module mounted in place.

The purpose of the mounting strip 18 is to receive and secure a plurality of AC connector modules 34 (FIGS. 3–5) at any desired vertical positions in the rack at which power converters or other pieces of equipment need to be plugged into an AC supply. FIG. 3 shows the body or case 36 of the AC connector module 34. A set of rails 38 extends along the rear and side of the body 36 and is so dimensioned that the peripheral faces of the rails 38 lie against the perimeter of the apertures 28, 30 when the AC connector module 34 is inserted between the flanges 24 and 26. The AC connector module 34 is inserted by first hooking the end 40 of the rail set 38 under the periphery of the aperture 30.

One or more resilient locking clips 42 are formed on the opposite side of body 36. When the connector module 34 is hooked under the aperture 30 and pushed rearward, the hooks 44 on the clips 42 snap into place under the apertures 32 (FIG. 2) and lock the connector module 34 into place. In this position (illustrated in FIG. 4*a*), the AC connector module 34 is securely but releasably held against movement in any direction by the peripheries of the apertures 28, 30 and 32.

Figure 4B:
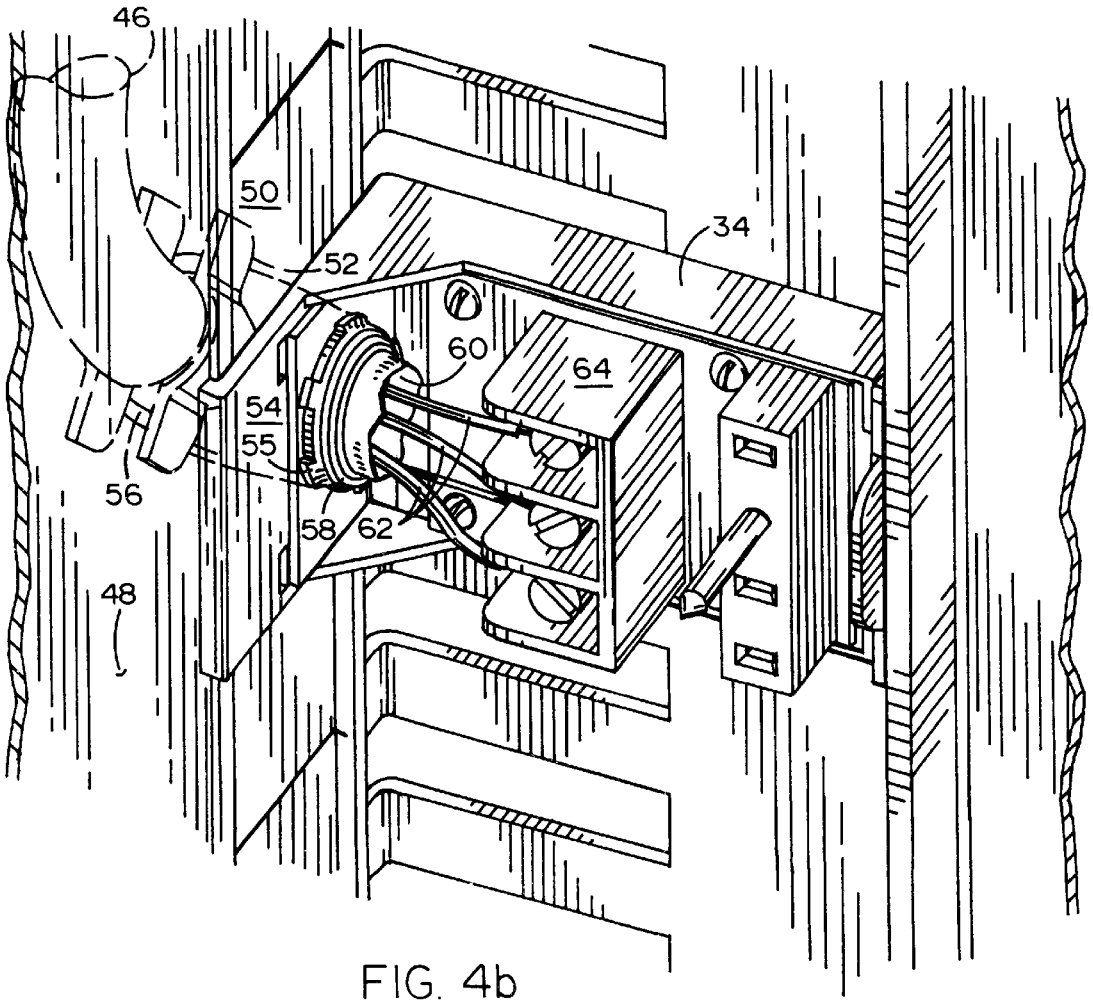

The installed position of AC connector module 34 is shown in detail in FIG. 4*b*. In that figure, a cable 46 which has been brought out of the cable duct 16 through one of the knockouts 48 terminates in the space 50 between the flange 24 and the cable duct 16. A cable clamp 52 is secured to the side wall 54 of the AC connector module 34. An elbow 56 protrudes through the opening 58 in side wall 54 and brings the end 60 of the cable 46 into the interior of AC connector module 34. There, its individual wires 62 can safely be separated and conventionally attached to the terminal block 64. Elbow 56 is fastened to side wall 54 by means of a conventional nut 55.

Figure 5:
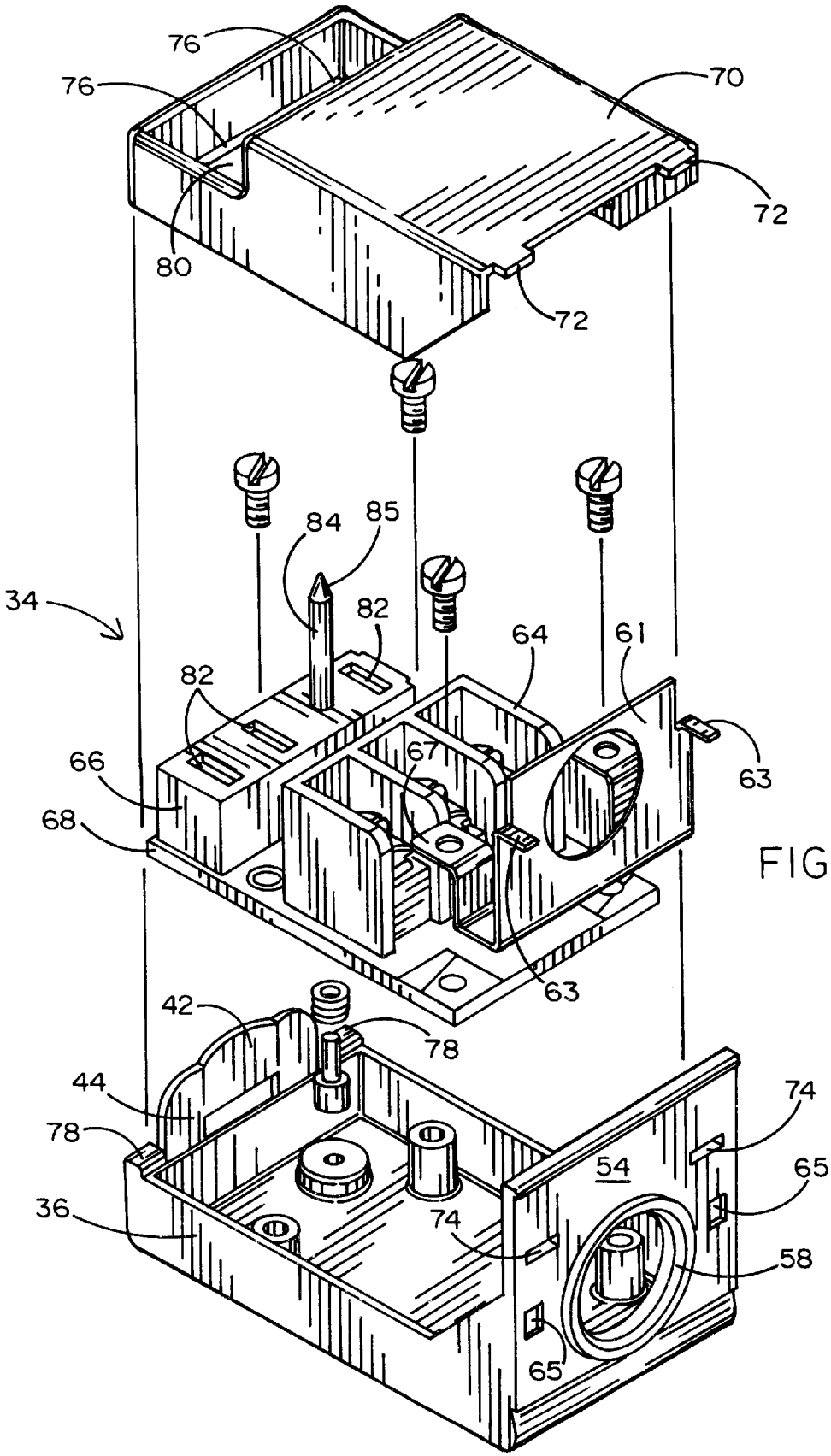
FIG. 5 is an exploded front view of the AC connector module.

The interior of AC connector module 34 is shown in more detail in the exploded view of FIG. 5. The terminal block 64 and the contact block 66 of AC connector module 34 are mounted on a printed circuit card 68 which provides the interconnections between the terminal block 64 and the contact block 66 through contact pads (not shown) on the rear side of blocks 64 and 66. A small metallic plate 61 is preferably also provided to complete a grounding circuit between the armored cable jacket of cable 46 (not shown) and the ground terminal of terminal block 64. As best seen in FIG. 5, plate 61 is fastened to the side wall 54 via nut 55 and tabs 63 which fit through slots 65 and are then bent down to ensure secure fastening to side wall 54. Metallic plate 61 further includes a 90 degree strain relief elbow 67 that connects plate 61 to the ground terminal of terminal block 64.

An insulated snap-on cover 70 has tabs 72 which engage the slots 74 in wall 54, and tabs 76 which lockingly engage the hooked arms 78 of the body 36. When the cover 70 is snapped onto the body 36, only the contact block 66 protrudes through the opening 80 of the cover 70.

The contact block 66 preferably has three female contacts 82 and a pin 84 which serves both as an alignment guide (by virtue of its beveled end 85) and as a ground connection which makes contact first and breaks contact last when a power converter or other piece of equipment is plugged into, or withdrawn from, the AC connector module 34.

Figure 6:
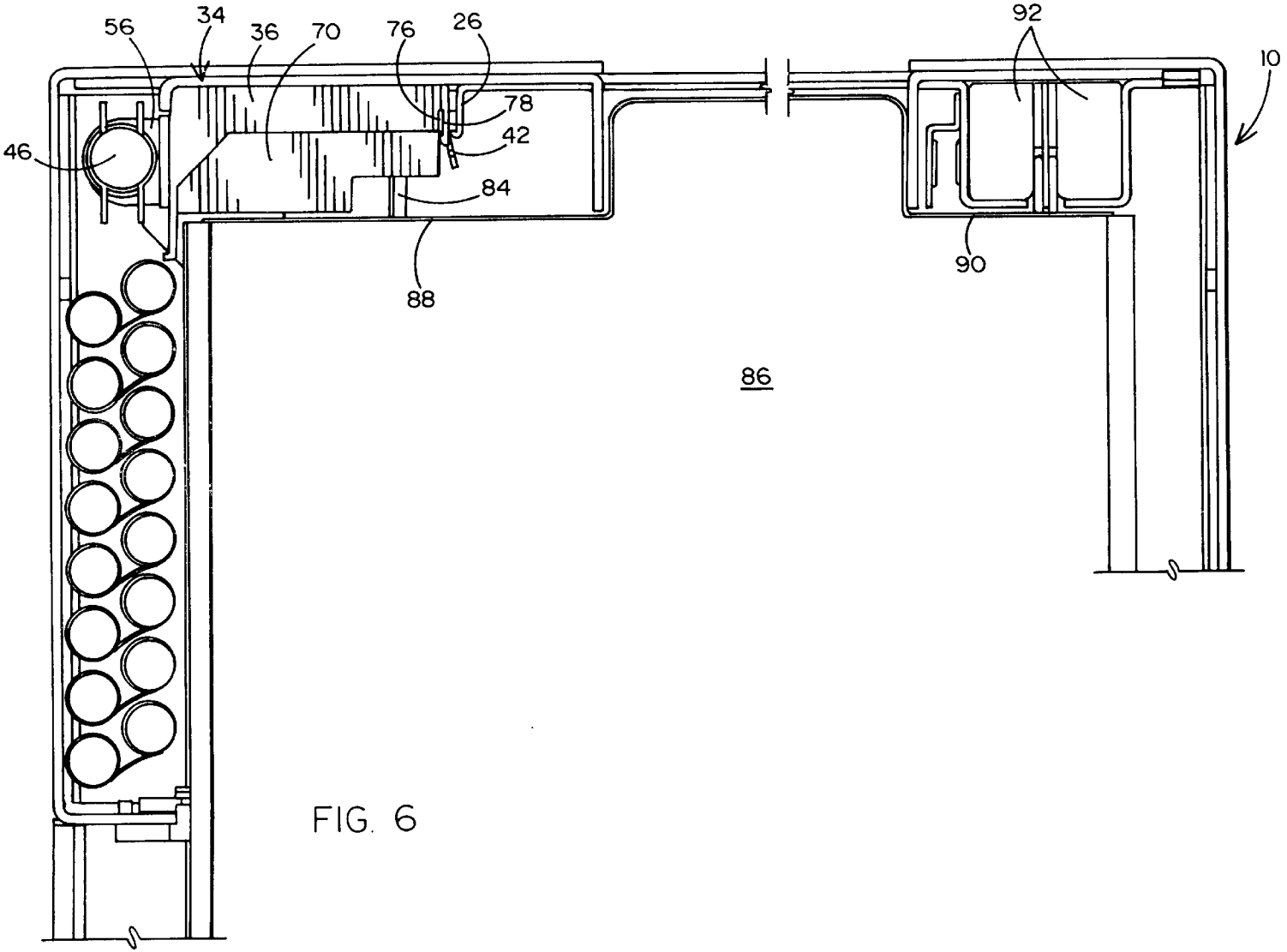
FIG. 6 is a horizontal section of the rack showing a power converter or the like installed in an equipment rack and connected to an AC connector module according to the present invention.

It will be understood that the present invention assumes the use, on power converters or other equipment intended to work with it, of a plug-in male connector so located on the equipment chassis that it will engage the AC connector module 34 when the chassis is slid into place in the rack 10. This location is illustrated by the horizontal section of FIG. 6, in which a power converter 86 is shown in place in the rack 10. The converter 86 can rest on conventional slides similar to drawer slides (not shown). The rear face of its chassis has recessed portions 88, 90. The recessed portion 88 provides space for the AC connector module 34, while the recessed portion 90 provides space for a DC and data connection to a bipolar DC bus structure 92.

Although preferred and alternative embodiments of the present invention and modifications thereof have been described in detail herein, it is to be understood that this invention is not limited to those precise embodiments and modifications, and that other modifications and variations may be created by one of ordinary skill in the art without departing from the spirit and scope of the invention as defined in the appended claims.

What is claimed is:

1. An AC power connecting system for electrical equipment racks, comprising:

a) a rack arranged to support a plurality of equipment chassis at selectable heights, said rack having a vertically extending connector mounting strip;

b) said mounting strip having a plurality of closely vertically spaced apertures formed therein;

c) an AC connector module arranged to be removably mounted on said mounting strip at a selected height, said connector module including:

i) a body having a rear wall and a side wall and defining an opening through which AC power supply wires can be inserted;

ii) a rail extending outwardly from said rear and side walls and arranged and dimensioned so as to engage one of said apertures and cooperate therewith to prevent vertical and horizontal forward and rearward movement of said body when said rail is engaged with said aperture; and iii) a resilient locking tab on said body arranged to releasably engage an edge of said aperture to hold said body in engagement with said aperture; and d) a contact block arranged to mate with a device requiring AC power.

2. The system of claim 1, in which said AC connector module further includes:

i) a terminal block to which said AC power supply wires are attached; and ii) a printed circuit card mounted in said body, said terminal block being mounted on said printed circuit card, said printed circuit card being arrayed to provide interconnections between said terminal block and said contact block.

3. The system of claim 2, in which said contact block includes a plurality of contacts, and further includes a grounding and aligning pin which has a beveled tip and protrudes from said contact block sufficiently far to be the first element of said AC connector module to engage and align the device being plugged thereinto.

4. The system of claim 3, wherein the device is an equipment chassis and wherein said grounding and aligning pin has a beveled tip which engages an equipment chassis to align it with said AC connector module as said chassis is plugged into said AC connector module.

5. The system of claim 1, in which said rack includes an enclosed vertical cable duct adjacent and parallel to said mounting strip, said cable duct having a wall portion with knock-out openings at heights corresponding to said apertures on said mounting strip, whereby individual AC cables can be brought out from said duct adjacent said AC connector modules.

6. The system of claim 5, in which said AC connector modules include cable clips mounted thereon exteriorly thereof to hold said AC cables against stress as each is coupled to a respective one of said AC connector modules.

7. The system of claim 1, in which said mounting strip is of U-shaped cross section with a base plate and forwardly extending flanges, said plurality of apertures having a first plurality of apertures being formed in said base plate and extending into one of said flanges and a second plurality of apertures extending from said base plate into the other of said flanges.

* * * * *